US005504324A

United States Patent [19]

Armentrout

[11] Patent Number: 5,504,324

[45] Date of Patent: Apr. 2, 1996

[54] SOFT X-RAY IMAGING DEVICE EMPLOYING A CYLINDRICAL COMPRESSION SPRING TO MAINTAIN THE POSITION OF A MICROCHANNEL PLATE

[75] Inventor: Charles Armentrout, Ann Arbor, Mich.

[73] Assignee: Pilot Industries, Inc., Dexter, Mich.

[21] Appl. No.: 427,342

[22] Filed: Apr. 24, 1995

Related U.S. Application Data

[63] Continuation-in-part of Ser. No. 232,839, Apr. 25, 1994.

[51] Int. Cl.[6] ..... H01J 40/14

[52] U.S. Cl. ..... 250/214 VT; 250/207; 313/528

[58] Field of Search ..... 250/214 VT, 207; 313/525, 527, 528, 529, 542, 543, 103 CM

[56] References Cited

U.S. PATENT DOCUMENTS

| | | | |
|---|---|---|---|
| 3,742,230 | 6/1973 | Spears et al. | 250/65 R |
| 3,743,842 | 7/1973 | Smith et al. | 250/320 |
| 3,906,237 | 9/1975 | Pittaway | 250/489 |
| 4,142,101 | 2/1979 | Yin | 250/363 R |
| 4,242,588 | 12/1980 | Silk et al. | 250/492 |
| 4,255,666 | 3/1981 | Wang et al. | 250/486 |
| 4,264,815 | 4/1981 | Reuter | 250/31 |
| 4,589,113 | 5/1986 | Hagelstein | 372/5 |
| 4,592,064 | 5/1986 | Silfvast | 372/73 |
| 4,644,574 | 2/1987 | Dahn | 378/58 |
| 4,692,934 | 9/1987 | Forsyth | 378/34 |
| 4,736,401 | 4/1988 | Donges et al. | 378/146 |
| 4,748,647 | 5/1988 | Kaiser et al. | 378/50 |
| 4,791,655 | 12/1988 | Nagata et al. | 378/57 |
| 4,840,872 | 6/1989 | Endo et al. | 430/273 |
| 4,852,133 | 7/1989 | Ikeda et al. | 378/34 |
| 4,937,832 | 6/1990 | Rocca | 372/5 |
| 4,945,551 | 7/1990 | Makabe et al. | 378/34 |
| 5,025,144 | 6/1991 | Odom et al. | 250/207 |
| 5,034,971 | 7/1991 | Suzuki | 378/35 |
| 5,045,696 | 9/1991 | Hirose | 250/306 |
| 5,047,650 | 9/1991 | Harada et al. | 250/505.1 |
| 5,192,861 | 3/1993 | Breskin et al. | 250/214 VT |
| 5,220,169 | 6/1993 | Ninomiya | 250/358.1 |
| 5,239,566 | 8/1993 | Nakamura et al. | 378/43 |
| 5,338,927 | 8/1994 | de Groot et al. | 250/214 VT |
| 5,359,187 | 10/1994 | Weiss | 250/214 VT |
| 5,369,268 | 11/1994 | Van Aller et al. | 250/214 VT |

OTHER PUBLICATIONS

"ITT X–Ray Converter Configurations," ITT Corporation, Jul. 15, 1986 Armentrout.

"Demountable MCP Assembly Series," Hamamatsu Corp., Technical Data Sheet, Jan. 1985.

"VUW–8990 Series," Varian Corp., Technical Data Sheet, Jun. 1979.

"The Microchannel Image Intensifier," *Michael Lampton*, pp. 62–71, *Scientific American* (Nov. 1981).

"Galileo Detector Assemblies," *Galileo Electro–Optics Corporation*, Data Sheet No. 7000, pp. 1–16, Mar. 1987.

*Primary Examiner*—Edward P. Westin
*Assistant Examiner*—Steven L. Nichols
*Attorney, Agent, or Firm*—Gifford, Krass, Groh, Sprinkle, Patmore, Anderson & Citkowski, et al.

[57] ABSTRACT

A soft x-ray imaging device is disclosed having a housing defining a housing chamber. A faceplate having a planar surface is secured to the housing so that the planar surface is positioned within the housing chamber. A phosphorus coating is applied to the planar surface of the faceplate for convening electrons to visible light. A microchannel plate for convening x-rays to electrons is secured within the housing chamber so that the microchannel plate is spaced from and parallel to the planar surface of the faceplate. An opening is formed in the housing in alignment with the microchannel plate and this opening is sealingly closed by a window which is made of a material substantially transparent to soft x-rays. This window also creates a vacuum tight housing chamber which is continuously evacuated by a pump.

16 Claims, 2 Drawing Sheets

SOFT X-RAY IMAGING DEVICE EMPLOYING A CYLINDRICAL COMPRESSION SPRING TO MAINTAIN THE POSITION OF A MICROCHANNEL PLATE

This is a Continuation-in-part of copending application Ser. No. 08/232,839 filed on Apr. 25, 1994.

BACKGROUND OF THE INVENTION

1. Field of the Invention

The present invention relates to an imaging device for soft x-rays.

2. Description of the Prior Art

There are many types of previously known imaging devices for use with x-rays. For example, imaging devices for hard x-rays, i.e. x-rays having an energy in excess of 30 KeV, are typically used in the medical and manufacturing industries. Such hard x-ray imagers are advantageous since hard x-rays pass essentially without attenuation through air and thus are convenient for medical and certain industrial applications. Hard x-ray imagers, however, only enjoy a resolution of about one-tenth millimeter which, while adequate for most medical applications, is inadequate for many industrial inspection applications.

The previously known imaging devices for hard x-rays, however, have not proven satisfactory as imaging devices for soft x-rays, i.e. x-rays having an energy of less than 20 KeV, for a number of reasons. For example, soft x-rays rapidly attenuate in air and thus are difficult for many applications, such as medical applications, where the x-ray radiation must necessarily pass through air. Also, the image conversion techniques previously used employ conversion techniques from x-ray to visible light that severely lose efficiency for x-ray energies much below 30 keV. This makes them very poor choices for image converters in soft x-ray applications.

There are previously known soft x-ray imaging devices and many of these previously known devices use microchannel plates for converting and multiplying x-rays to electrons. In one such imaging device the microchannel plate was supported by spaced pins and the entire x-ray imager was employed in essentially a complete vacuum. Such a mounting system for the microchannel plate is disadvantageous since the microchannel plate may distort and warp the image. Furthermore, many of these devices must be used in a vacuum and therefore are inappropriate for most industrial applications. These posts must be constructed in matched sets, carefully aligned to the exact distance between the microchannel plate and the baseplate that holds the imaging faceplate. Due to the possibility of a tilt in the faceplate and the baseplate, each post must be constructed for a specific location on a specific imaging unit.

In still another type of x-ray imaging device, the microchannel plate is supported in a housing by thin disks and the housing, in turn, is sealed. These imagers, however, are easily broken and/or become misaligned when subjected to shock. Similarly, the thin disks which mount the microchannel plate to the housing fatigue and sag over time which distorts the image. Furthermore, the atmosphere within the chamber becomes cloudy over time due to outgasing from the parts inside the chamber, and diffusion through the housing which adversely affects the image.

A still further disadvantage of these previously known imaging devices is that, over time, gases entrapped within the microchannel plate leach out into the sealed housing chamber and can damage or otherwise degrade the imaging device.

SUMMARY OF THE PRESENT INVENTION

The present invention provides an imaging device for soft x-rays which overcomes all of the above mentioned disadvantages of the previously known devices.

In brief, the soft x-ray imaging device of the present invention comprises a housing defining a housing chamber. A faceplate is constructed of a material, such as glass or optic fibers, which is transparent to light and the faceplate is secured to the housing so that a planar surface on the faceplate is positioned within the housing chamber. Means, such as a phosphorus coating, are applied to the planar surface of the faceplate for converting electrons to visible light.

A microchannel plate for transforming x-rays to electrons is also secured within the housing chamber by a cylindrical stand which is an electrode for the microchannel plate and also is a rigid stand whose strength is assured by the cylindrical walls of the stand so that the microchannel plate is parallel to but spaced from the phosphorous coating on the faceplate. A cylindrical spring is then compressed between the housing and the side of the microchannel plate opposite from the ring thus firmly securing the microchannel plate, cylindrical electrode stand and housing together.

The housing also includes an opening in alignment with the microchannel plate. This opening is sealingly closed by a window made of a material, such as EVOH plastic sandwich material or beryllium, which is substantially transparent to soft x-rays. The window also forms a vacuum tight housing chamber in which the microchannel plate is contained.

A vacuum pump, such as an ionic pump, continuously evacuates the housing chamber. Thus the vacuum pump removes all gases which enter the housing chamber through diffusion, outgasing or otherwise.

In operation, the housing chamber is evacuated while appropriate electric voltage potentials are applied to the opposite sides of the microchannel plate as well as the coating on the faceplate planar surface. The microchannel plate then transforms and multiplies x-rays passing through the window and onto the microchannel plate to electrons. These electrons, in turn, strike the coating on the faceplate and are convened to visible light. This visible light can then be viewed through the other end of the faceplate.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
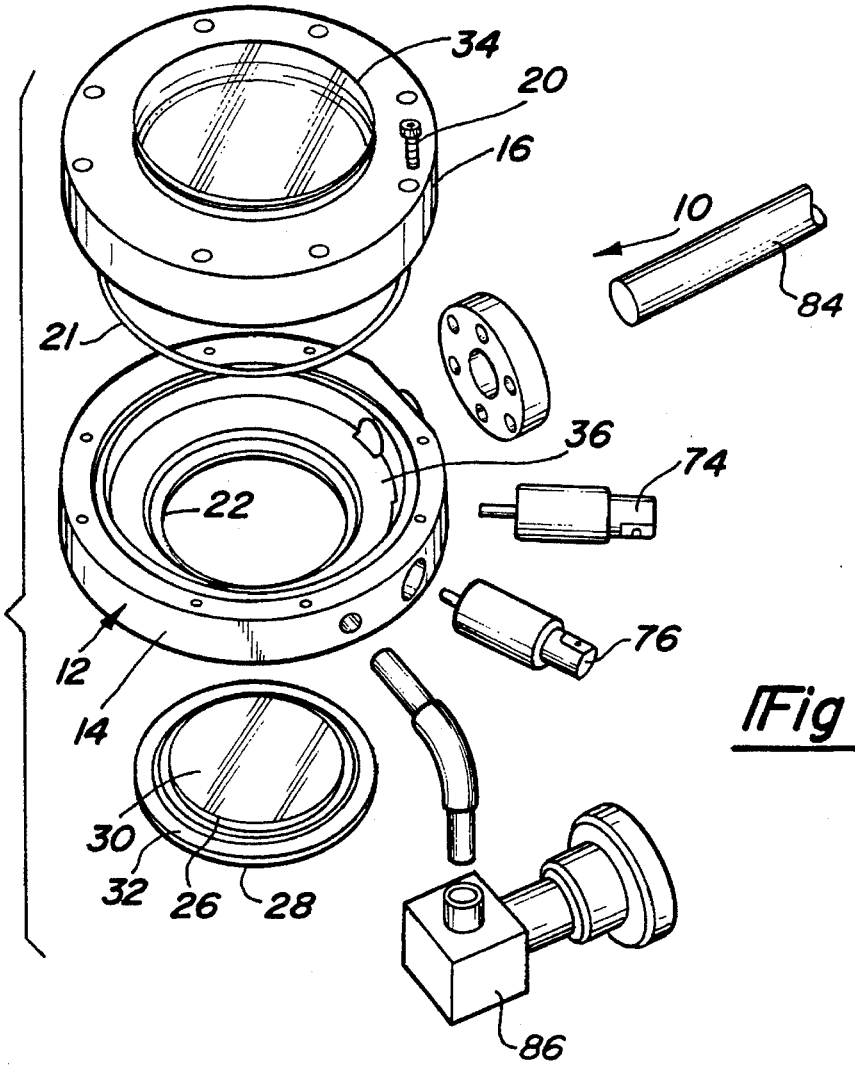
FIG. 1 is an exploded view illustrating a first preferred embodiment of the present invention.
Figure 2:
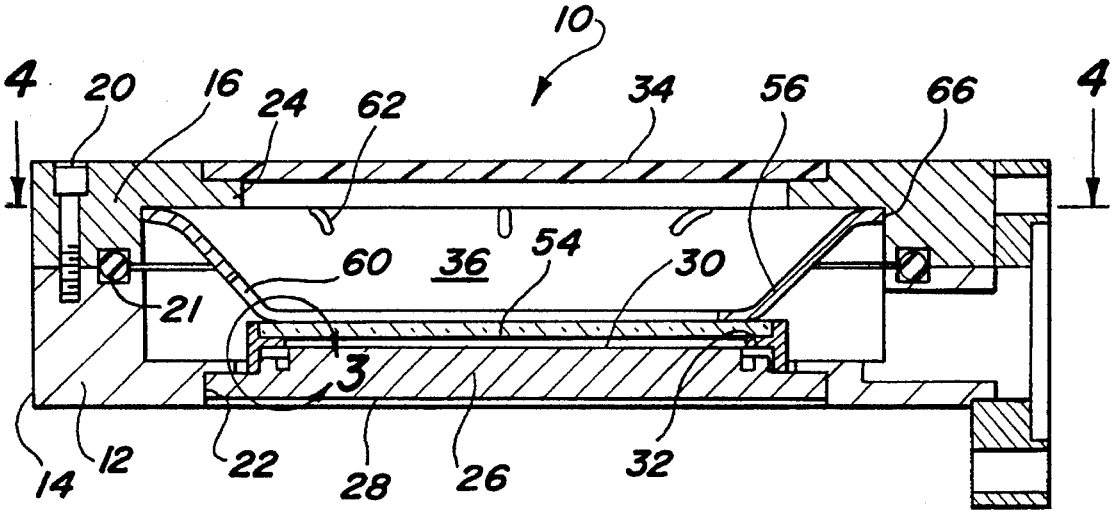
FIG. 2 is a fragmentary cross sectional view illustrating the preferred embodiment of the present invention.

With reference first to FIGS. 1 and 2, a preferred embodiment of the soft x-ray imaging device 10 of the present invention is thereshown and comprises a housing 12 having an annular base plate 14 and an annular top plate 16. The base plate 14 and top plate 16 are secured together by any conventional fasteners 20 while an O-ring 21 disposed between the plates 14 and 16 fluidly seals the plates 14 and 16 together. The base plate 14 further includes a circular opening 22 which is aligned with a circular opening 24 in the top plate 16.

A generally cylindrical faceplate 26 has a first planar surface 28 and a second planar surface 30 which are spaced apart and parallel to each other. The faceplate 26 is constructed of an electrical insulating material substantially transparent to light, such as fiber optic material or glass. The faceplate 26 includes an outer flange 32 which is secured to the opening 22 in the base plate 14 by any conventional means, such as epoxy adhesive.

Still referring to FIGS. 1 and 2, a window 34 constructed of a material which is substantially transparent to soft x-rays is secured across the opening 24 in the top plate 16 by any conventional means, such as an epoxy adhesive. The window 34 can be constructed of an Ethylene Vinyl Alcohol (EVOH) material, other synthetic material or beryllium. Furthermore, with the housing plates 14 and 16 secured together as shown in FIG. 2, a closed internal housing chamber 36 is formed.

Figure 3:
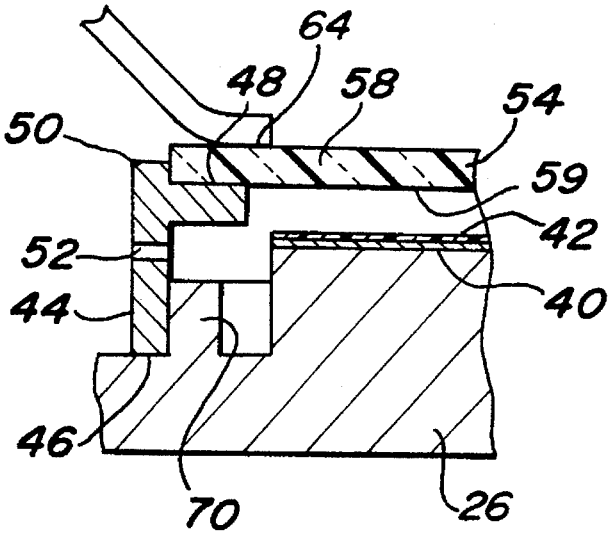
FIG. 3 is an enlarged view of circle 3—3 in FIG. 2.

As shown in FIG. 3, the surface 30 of the faceplate 26 contained within the housing chamber 36 is coated with an electrically conductive layer 40, such as a thin indium coating optionally doped with tin, although other electrically conductive materials may alternatively be used. The electrically conductive layer 40 in turn is covered with a coating of a material, such as a phosphorous coating 42, which converts electrons to visible light. Thus, electrons striking the phosphorous coating 42 may be viewed through the opposite surface 28 of the faceplate 26.

As best shown in FIGS. 2 and 3, a cylindrical support stand 44 has one end 46 supported by the faceplate 26 and an annular abutment surface 48 at its other end. An axially protruding rim 50 extends around the abutment surface 48 for a reason to be shortly described. Furthermore, as best shown in FIG. 3, the support stand 44 includes a plurality of openings 52 formed radially through it to enable gas flow through the ring 44.

With reference still to FIGS. 2 and 3, a circular microchannel plate 54 is positioned upon and supported by the abutment surface 48 of the stand 44 such that the microchannel plate 54 is spaced from but parallel to the surface 30 of the faceplate 26.

Figure 4:
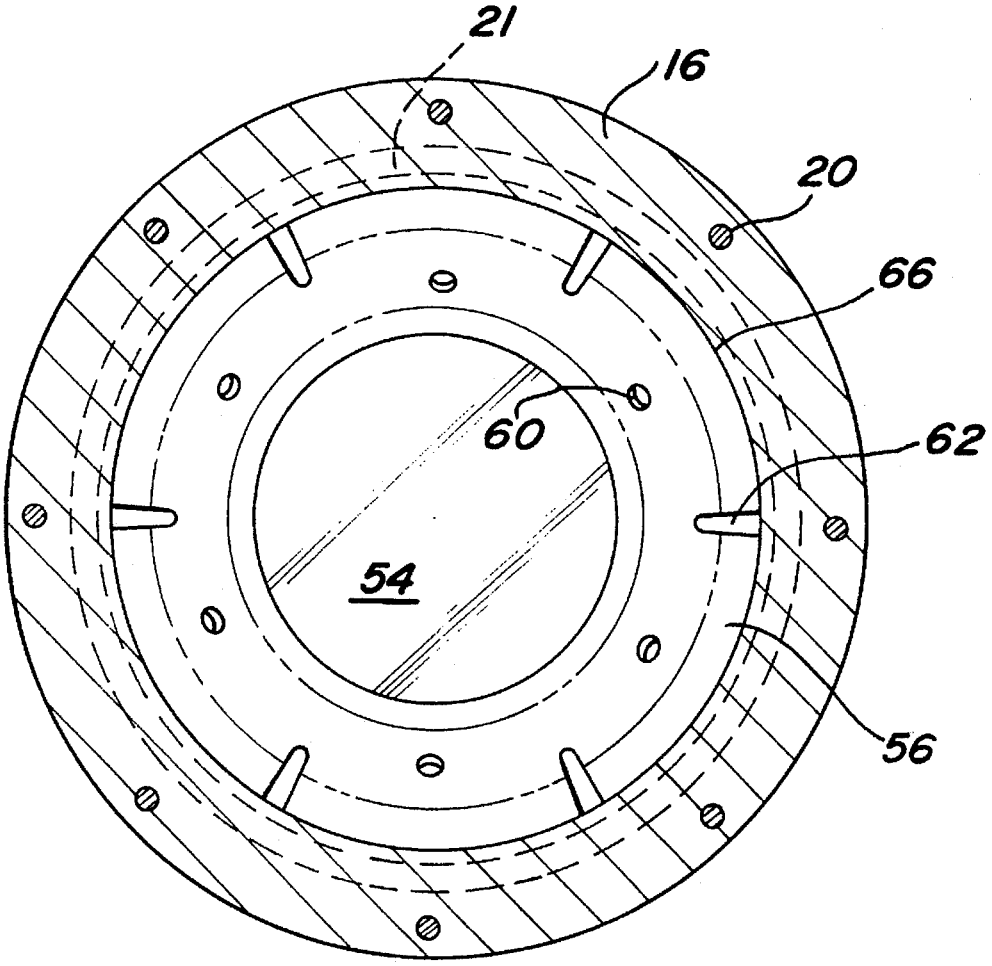
FIG. 4 is a cross-sectional view taken along line 4—4 in FIG. 2.

With reference now to FIGS. 2, 3 and 4, in order to maintain the microchannel plate 54 securely against the stand off ring 44, an annular cylindrical spring 56 is compressed in between the top plate 16 of the housing 12 and one side 58 of the microchannel plate 54. The spring 56 is preferably of a thin-wall metal construction having a formed cylindrical base which enhances the strength of the spring 56. The spring 56 also has a plurality of openings 60 formed through it so the gas can flow through the spring 56 and these holes also add to the "springiness" of the spring 56. Additionally, a plurality of radially extending and circumferentially spaced slots 62 (FIG. 4) are provided around the spring 56.

In practice, the inner periphery 64 of the spring 56 abuts against the surface 58 of the microchannel plate 54 while, conversely, the outer periphery 66 of the spring 56 abuts against the housing top plate 16. The spring 56 exhibits a generally linear compression of about one pound per thousandth inch of compression of the spring 56. Consequently, by dimensioning the spring 56 such that when in its uncompressed state the housing base plate 14 and top plate 16 are spaced apart by $^{50}/_{1000}$ of an inch, securing the housing plates 14 and 16 together by the fasteners 20 compresses the spring 56 by $^{50}/_{1000}$ of an inch and thus exerts a 50 lb. pressure around the outer annular periphery of the microchannel plate 54. Such a force not only ensures that the microchannel plate 54 remain in flat abutment with the support stand 44 but also prevents any movement of the microchannel plate 54 relative to the stand off ring 44 or housing 12.

With reference now particularly to FIG. 3, in the preferred embodiment of the invention, the faceplate 26 includes an upwardly extending annular lip 70 positioned interiorly of the stand off ring 44. This lip 70 increases the electrical discharge path between the stand off ring 44 and the conductive layer 40 on the faceplate 26 thus reducing the possibility of arcing between the stand off ring 44 and conductive layer 40. This lip also allows the imposition of higher voltages, thus providing brighter images.

In the conventional fashion, each side 58 and 59 of the microchannel plate 54 is covered with an electrically conductive material. The outer side 58 of the microchannel plate 54 is electrically connected to the housing 10 via the spring 56 and is generally maintained at a ground electrical potential. Conversely, the other side 59 of the microchannel plate 54 is electrically connected to the support electrode 44 which, in turn, is maintained at a relatively high voltage potential, e.g. 1,000 volts. The conductive layer 40 on the faceplate 26, in turn, is electrically connected to an even higher electric voltage, e.g. 7,000 volts.

Suitable electric connectors 74 and 76 are provided for the electrical connections to both the stand off ring 44 as well as the electrically conductive coating 40. Furthermore, electrical connector 76 is connected to the conductive layer 40 via a wire extending through registering slots in both the support electrode 44 and rim 70. A tube constructed of an electrically insulating material, such as glass, is provided around the wire as it extends through the support electrode 44 to prevent contact between the ring 44 and wire.

In order to prevent arcing between the microchannel plate 54 and the conductive layer 40 on the faceplate 26, it is necessary that the housing chamber 36 be maintained at a near absolute vacuum. In order to achieve this vacuum, the housing chamber 36 is first evacuated by any conventional vacuum pump (not shown) via a fluid conduit 84 (FIG. 1). The conduit 84 is then crimped or otherwise sealed in order to prevent gas from leaking back through the conductor 84 and into the housing chamber 36.

It has been found that, during operation of the imaging device, gases that are entrapped within the microchannel plate 54 leach out of the microchannel plate 54 and into the housing chamber 36. Gases are also evolved from the phosphors layer during operations and additionally from all materials in the construction of the device from outgasing. Such gases degrade and would otherwise damage the imaging device 10. Therefore, in order to remove these leach gases, a pump, such as an ionic pump 86, is fluidly connected to the housing chamber 36 and continuously evacuates the housing chamber 36 during operation of the imaging device.

In operation, soft x-rays which pass through the window 34 strike the microchannel plate 54. In response to the soft x-rays the microchannel plate 54 generates a cascade of electrons which are drawn by the electric potential on both the side 59 of the microchannel plate 54 as well as the conductive layer 40 on the faceplate 26 towards the phosphor layer 42 on the faceplate 26. Once electrons strike the phosphor layer 42, the phosphor layer 42 converts the electrons to visible light which is then viewed through the lower side 28 of the faceplate 26.

From the foregoing, it can be seen that the present invention provides a simple and yet highly effective imaging device for soft x-rays. The present invention is particularly useful for imaging soft x-rays in the range of 5–20 KeV which enables much higher resolution than hard x-ray imaging devices. This imaging in soft x-rays allows examination of low density materials which hard x-rays penetrate fully and are unable to resolve.

Having described my invention, however, many modifications thereto will become apparent to those skilled in the art to which it pertains without deviation from the spirit of the invention as defined by the scope of the appended claims.

I claim:

1. A soft x-ray imaging device comprising:

a housing defining a housing chamber, a faceplate having a planar surface, said faceplate being constructed of a material substantially transparent to visible light, means for securing said faceplate to said housing so that said planar surface is positioned in said housing chamber, means on said planar surface of said faceplate for converting electrons to visible light, means for transforming x-rays to electrons, said x-ray transforming means having two spaced apart and parallel sides, means for mounting x-ray transforming means within said housing chamber so that said transforming means is spaced from and parallel to said planar surface of said faceplate, said mounting means comprising a cylindrical electrode secured in said housing chamber and having an annular surface, said surface on said electrode substantially continuously abutting and supporting one side of said x-ray transforming means, and a resilient cylindrical compression spring compressed between said housing and the other side of said x-ray transforming means.

2. The invention as defined in claim 1 wherein said transforming means comprises a microchannel plate.

3. The invention as defined in claim 1 wherein said housing includes an opening in alignment with said transforming means and comprising means substantially transparent to soft x-rays sealingly disposed across said housing opening.

4. The invention as defined in claim 3 wherein said sealing means comprises a sheet of ethylene vinyl alcohol copolymer.

5. The invention as defined in claim 3 wherein said sealing means comprises a sheet of beryllium.

6. The invention as defined in claim 1 wherein said converting means comprises a phosphorous coating.

7. The invention as defined in claim 1 and comprising an electrically conductive coating on said planar surface of said faceplate.

8. The invention as defined in claim 1 and comprising means for continuously evacuating said housing chamber during operation of the imaging devices.

9. The invention as defined in claim 8 wherein said evacuating means comprises an ionic pump.

10. The invention as defined in claim 1 wherein said housing includes an opening and wherein a second end of said faceplate is positioned in said housing opening.

11. The invention as defined in claim 1 wherein most of the soft x-rays have an energy in the range of five–fifteen KeV.

12. The invention as defined in claim 1 wherein said spring comprises an annular cylinder having an inner periphery and an outer periphery, said spring abutting against said x-ray transforming means adjacent its inner periphery.

13. The invention as defined in claim 12 wherein said spring includes a plurality of circumferentially spaced and radially extending slots about its outer periphery and a plurality of spaced holes formed through the spring.

14. The invention as defined in claim 1 wherein one end of said electrode abuts against a flange secured to and extending outwardly from said faceplate and a rim constructed of an electrically insulating material positioned between said ring and said faceplate.

15. The invention as defined in claim 14 wherein said rim is integrally formed with said faceplate.

16. The invention as defined in claim 1 wherein said faceplate is constructed of optic fibers.

* * * * *